United States Patent [19]

Thompson

[11] Patent Number: 4,741,136

[45] Date of Patent: May 3, 1988

[54] EDGE FASTENER FOR CAULKLESS JOINTED PANELS

[76] Inventor: Gerald M. Thompson, 1437 Creekside Dr., Wheaton, Ill. 60187

[21] Appl. No.: 916,789

[22] Filed: Oct. 8, 1986

[51] Int. Cl.[4] ..... E04C 1/10; E04C 2/20

[52] U.S. Cl. ..... 52/302; 52/285; 52/309.11; 52/506; 52/589; 52/595

[58] Field of Search ..... 52/763, 478, 593, 483, 52/309.11, 285, 520, 595, 519, 521, 284, 285, 302, 588, 582, 584, 309.9, 506, 589, 510, 511, 394

[56] References Cited

U.S. PATENT DOCUMENTS

| | | | |
|---|---|---|---|
| 765,930 | 7/1904 | Mahony | 52/578 |
| 3,367,076 | 2/1969 | O'Brien | 52/309.11 |
| 3,714,747 | 2/1973 | Curran | 52/595 |
| 3,807,113 | 4/1974 | Turner | 52/595 |

FOREIGN PATENT DOCUMENTS

| | | | |
|---|---|---|---|
| 2259880 | 6/1974 | Fed. Rep. of Germany | 52/593 |
| 30943 | 2/1960 | Finland | 52/521 |
| 1511292 | 12/1967 | France | 52/593 |

*Primary Examiner*—John E. Murtagh

*Attorney, Agent, or Firm*—Clement and Ryan

[57] ABSTRACT

A two-piece edge fastener used to secure two adjoining building panels to a substrate or other supporting structure. One piece is a female fitting, for bonding to the edge of one of the panels, that has an outer portion defining a cavity with a shoulder on one side thereof. The second piece, for bonding to the edge of the other panel, is a male fitting having an outer portion carrying an outwardly extending protuberance whose free end is at least generally complementary to the shape of the cavity, with the outer portion of the male fitting having a shoulder on one side of the protuberance. A fastening flange extends outwardly from one of the fittings, providing a hole for receiving a fastener for attaching the fitting to the substrate or supporting structure. A masking member extends outwardly from the other fitting to conceal the fastener. The free end portion of the fastening flange terminates adjacent the shoulder on the other fitting, and the free end portion of the masking member terminates adjacent the shoulder of the fitting that carries the fastening flange. In some embodiments, the two free end portions actually abut the shoulders to form precise hairline joints. In other embodiments, three gaps are provided between the two fittings, with compressible, resilient gaskets in two of the gaps, while the third is left open.

9 Claims, 2 Drawing Sheets

FIG. 1
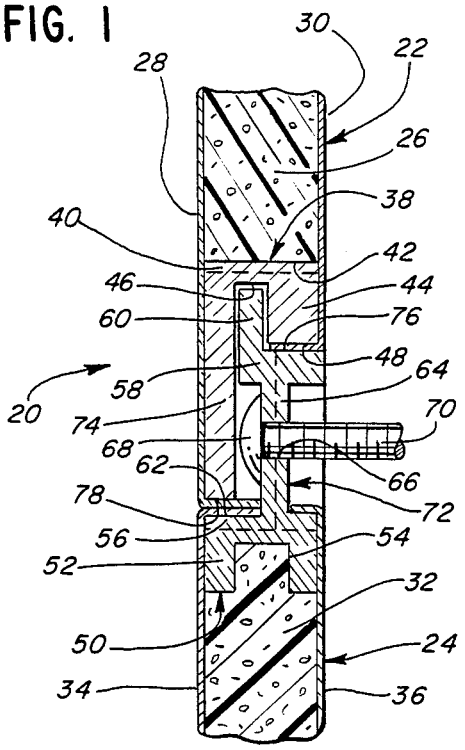
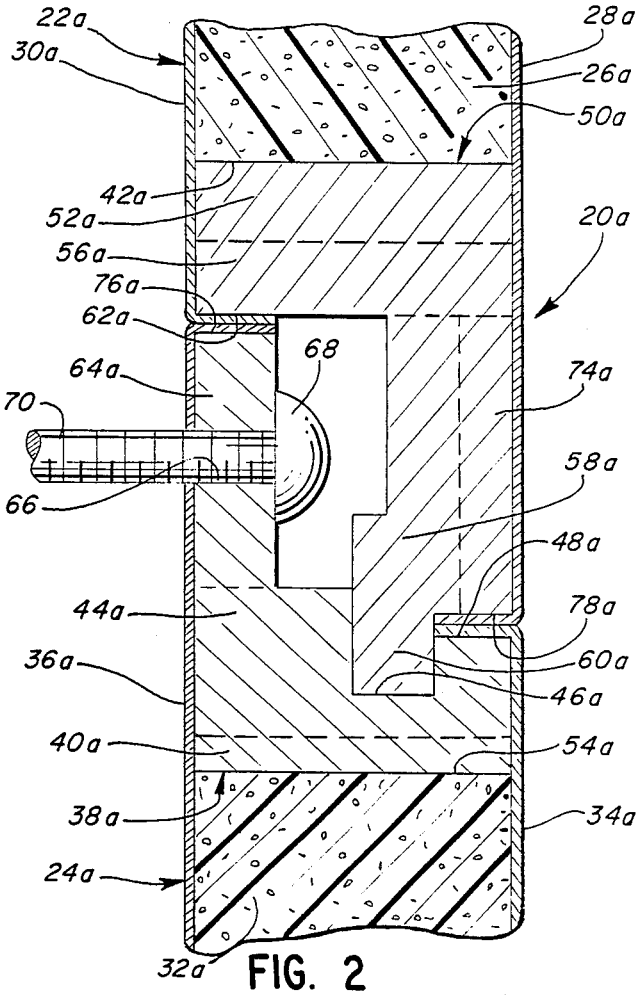
FIG. 2
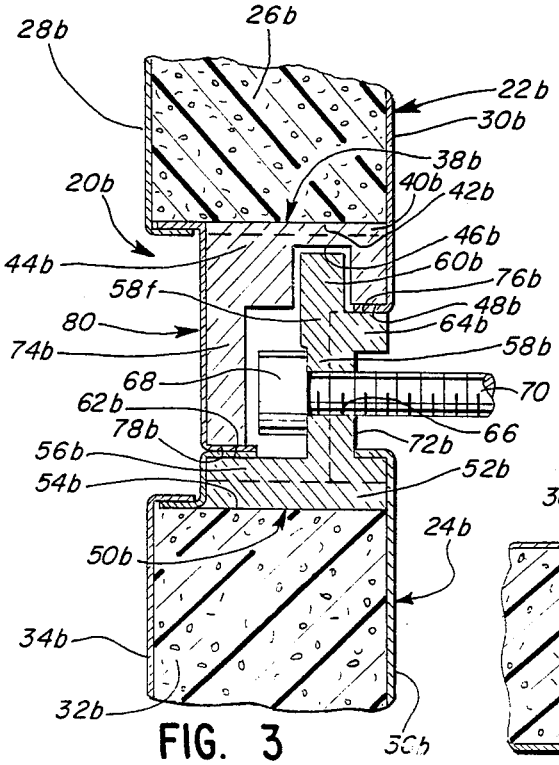
FIG. 3
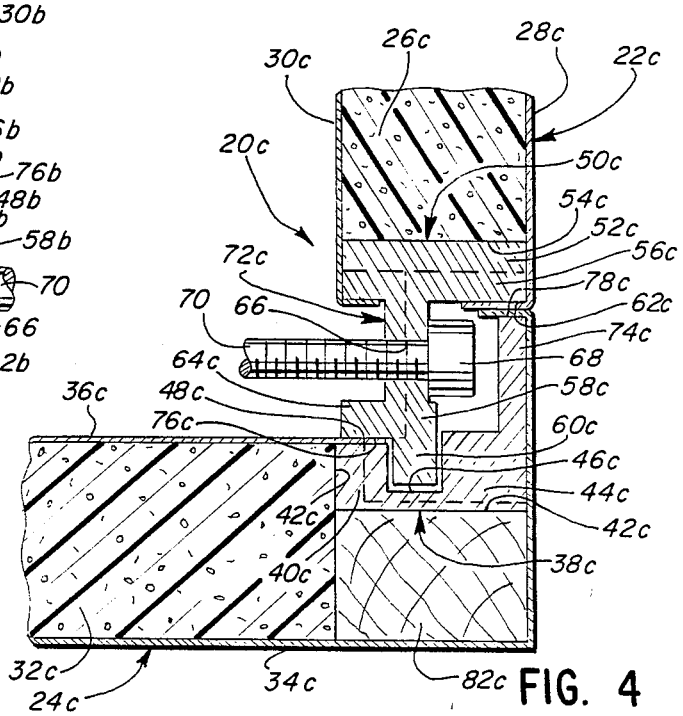
FIG. 4

EDGE FASTENER FOR CAULKLESS JOINTED PANELS

This invention relates to a two-piece edge fastener for bonding to the adjoining edges of two building panels, which panels may be laminated in form, to secure the panels to a substrate or supporting structure with a caulkless joint between the panels.

BACKGROUND OF THE INVENTION

The use of laminated structural panels of various compositions for facades, housings, flooring, roofing, ceilings and interior and exterior walls in industrial, commercial and other architectural projects is widespread. The versatility of these laminates, which exhibit high rigidity-to-weight properties, as well as excellent insulating and sound damping characteristics, has appeal with architects and engineers in a multitude of applications.

Such projects typically call for a series of structural laminated panels to be assembled as a housing or fastened to metal, masonry, wood, or other substrate or supporting structure as a facade or wall. The joint seams between adjacent laminated panels are often required to be sealed against environmental encroachment (i.e., water, wind, dust, heat, cold, fumes). In most instances this is accomplished by applying a wide layer of caulking material such as latex, butyrate, or silicone along the panel edges, or by sealing the edges with similar material into variously shaped channels which conceal the joint seams. Neither method is aesthetically satisfactory, and both are subject to imperfection when voids appear along the caulk line, permitting water incursion or other invasion during the service life of the joints. One of the principal advantages of the present invention is that it makes the use of caulking at the joints between adjacent panels unnecessary.

Assembling or fastening adjoining panels to produce perfect three dimensional alignment over modular framing or other substrates, which are usually of themselves not perfectly aligned, is a difficult, time-consuming and costly procedure. A wide variety of materials, components, and techniques are available to aid in assembly or installation of the end product. The vast majority of these aids add significantly to product costs either in materials, labor, or both. Many architectural projects require contractor specialists to achieve a satisfactory installation. In many situations, the use of formed channel or added subframing to conceal through-fasteners or joint seams is counter productive to performance or eye appeal of the end product.

Edge fasteners of various sorts have been employed for attaching adjacent building panels to each other and to vertical support members since at least as long ago as U.S. Pat. No. 765,930, which was issued to Mahony in 1904. Many other fastener devices such as those referred to in the immediately preceding paragraph have been employed in the intervening years, but so far as applicant is aware no one has ever devised an edge fastener that is similar in structure or performance to the edge fastener for caulkless jointed panels of the present invention.

SUMMARY OF THE INVENTION

The present invention makes it possible to retain the well known versatility of laminated structural panels, while virtually eliminating the objectionable features of currently available product that are referred to above.

The two-piece edge fastener of this invention, which is used to secure two adjoining building panels to a substrate or other supporting structure, comprises:

(1) A first, female fitting having an inner base portion for bonding to the edge of one of the panels that are to be connected to each other and secured to the substrate or other supporting structure, and an outer portion defining a cavity with a shoulder on one side thereof;

(2) a second, male fitting having an inner base portion for bonding to the edge of the other panel, and an outer portion carrying an outwardly extending protuberance, the free end of the protuberance having a shape at least generally complementary to the shape of the cavity, with the outer portion of the male fitting having a shoulder on one side of the protuberance;

(3) a fastening flange extending outwardly from the outer portion of one of the fittings adjacent the interior faces of the two panels when the panels are installed in place, this flange defining a hole for receiving a fastener for attaching the fitting in question to the substrate or supporting structure to which the panels are to be secured; and (4) a masking member extending outwardly from the outer portion of the other of the two fittings to conceal the fastener head from view when the fastener is installed in place securing the fitting that carries the fastener flange to the substrate or supporting structure. This masking member is spaced from the fastening flange to provide clearance for the fastener head.

Finally, the free end portion of the fastening flange that is carried by one of the fittings terminates adjacent the shoulder on the other fitting, and the free end portion of the masking member carried by that other fitting terminates adjacent the shoulder of the fitting that carries the fastening flange.

In some embodiments of this invention, the two free end portions just described actually abut the shoulders referred to, to form precise hairline joints. In other embodiments, the free ends of the members in question and the shoulders that are adjacent to them form gaps, as do the bottom of the cavity in the female fitting and the free end of the protuberance on the male fitting. To accommodate changes in the dimensions of the panels with expansion and contraction of the panels as a result of changes in the ambient temperature or absorbed solar heat, a compressible, resilient gasket is positioned in a slightly compressed state within two of these gaps, while the third is left open.

The male and female fittings just described key into each other to secure the panels to each other and to their substrate or other supporting structure. At the same time, each two-piece device conceals the fastened edges of the adjoining panels and forms a uniform joint (in some embodiments, as just stated, a precise hairline joint) between the panels.

BRIEF DESCRIPTION OF THE DRAWING

The invention will now be described in reference to the accompanying drawing, in which:

FIG. 1 is a sectional view in elevation of one embodiment of the edge fastener of this invention in which the fastening flange of the device extends from the male fitting and the masking member extends from the female fitting;

FIG. 2 is a sectional view in elevation of another embodiment of the edge fastener of this invention in which the fastening flange extends from the female fitting and the masking member extends from the male fitting;

FIG. 3 is a sectional view in elevation of another embodiment of the edge fastener of this invention that is basically similar to the embodiment of FIG. 1, in which a reveal is provided between the adjoining panels;

FIG. 4 is a sectional view in plan of another embodiment of the edge fastener of this invention that is incorporated in an outside corner between two adjoining panels;

FASTENER FOR VERTICALLY ADJACENT PANELS

Figure 5:
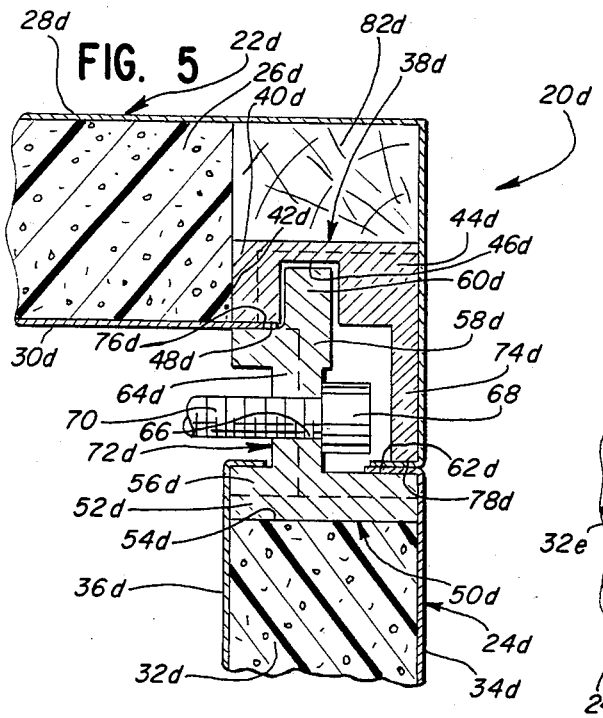
FIG. 5 is a sectional view in elevation of another embodiment of the edge fastener of this invention incorporated in a coping or sill formed by two adjoining panels.

In FIG. 1, two-piece edge fastener 20 secures laminated building panels 22 and 24 to each other and to a substrate or other supporting structure. Panel 22 includes lightweight core 26 formed of a foam plastic or other suitable material. Thin skin layers 28 and 30, formed of thin metal sheeting or other suitable material, are bonded to each face of core 26 to form a sandwich of the core between these two thin layers. Building panel 24 is similarly constructed of core 32 and thin skin layers 34 and 36. Panels 22 and 24 are vertically adjacent panels lying in the same general vertical plane.

Edge fastener 20 is adapted to secure panels 22 and 24 to a substrate or supporting structure (not shown) located on the right-hand side of FIG. 1. With the panels thus secured, interior face layers 30 and 36 of panels 22 and 24, respectively, are located adjacent the substrate or supporting structure.

Female fitting 38 has an inner base portion 40 for bonding to edge 42 of panel 22, and an outer portion 44 that defines cavity 46. Outer portion 44 of female fitting 38 has a shoulder 48 adjacent cavity 46 on one side of the cavity.

Male fitting 50 has an inner base portion 52 for bonding to edge 54 of panel 24, and an outer portion 56 that carries outwardly extending protuberance 58. Free end portion 60 of protuberance 58 has a shape generally complementary to the shape of cavity 46 of female fitting 38. Outer portion 56 of male fitting 50 has a shoulder 62 on one side of protuberance 58.

Fastening flange 64 extends outwardly from outer portion 56 of male fitting 50, adjacent interior faces 30 and 36, respectively, of panels 22 and 24 when the panels are installed in place. Fastening flange 64 defines hole 66 for receiving a fastener having an enlarged head 68 and a threaded shank 70. This fastener is adapted to attach male fitting 50 to the substrate or supporting structure for the building panels (not shown), which is located on the right-hand side of FIG. 1.

In the embodiment shown in FIG. 1, protuberance 58 and fastening flange 64 extend along the entire length of the edge of building panel 24, with both of those members projecting from outer portion 56 of male fitting 50 along that entire edge. If desired, protuberance 58 and fastening flange 64 may instead alternate along the length of the edge of the building panel.

In the embodiment shown, fastening flange 64 defines a groove 72 adjacent interior faces 30 and 36 of building panels 22 and 24 when the panels are installed in place. Groove 72 provides an exit channel for condensate and other liquid that may accumulate in the groove.

Masking member 74 extends outwardly from outer portion 44 of female fitting 38. Member 74 conceals fastener head 68 from view when the fastener if installed in place securing male fitting 50 to the substrate or supporting structure. As seen in FIG. 1, masking member 74 is spaced from fastening flange 64 to provide clearance for fastener head 68, which clearance extends from the midportion of the masking member to the free end of that member.

Free end 76 of fastening flange 64 terminates adjacent shoulder 48 of female fitting 38. Free end 78 of masking member 74 carried by female fitting 38 terminates adjacent shoulder 62 of male fitting 50.

The dimensions of edge fastener 20 are selected so that free end 76 of fastening flange 64 forms a first butt joint with shoulder 48 on female fitting 38. Free end 78 of masking member 74 forms a second butt joint with shoulder 62 of male fitting 50.

As those skilled in the art will recognize from the foregoing description and from the accompanying drawing, the component parts of edge fastener 20—i.e., female fitting 38, male fitting 50, fastening flange 64 and masking member 74 are all formed of a suitable rigid material such as, for example, extruded aluminum.

As seen in FIG. 1, when threaded shank 70 is rotated in the direction of its threads, fastener head 68 advances and is free to apply its full tightening force—through protuberance 58 carried by male fitting 50—to fastening flange 64. Fastening flange 64 is in turn fully tightenable against the substrate or supporting structure for the building panels.

In the embodiment shown in FIG. 1, exterior skin layer 28 of building panel 22 extends beyond the outer edge of free end 78 of female fitting 38, and folds inward into the second butt joint that is formed by shoulder 62 and free end 78. In the same way, exterior skin layer 34 of panel 24 extends beyond the outer edge of shoulder 62 on male fitting 50 and extends inward into the same butt joint between members 62 and 78. In situations in which variations in the dimensions of the building panels 22 and 24 because of changes in ambient temperature or any other reason do not need to be taken into account, this arrangement of parts produces a precise hairline joint between the two adjoining panels.

As also seen in FIG. 1, interior skin layer 30 of building panel 22 extends beyond the outer edge of shoulder 48 of female fitting 38, into the first butt joint that is formed by shoulder 48 and free end 76 of fastening flange 64. Here, again, in situations in which variations of dimensions with temperature changes are not a factor, a precise hairline joint is formed between building panel 22 and male fitting 50 on panel 24.

FIG. 2 is a sectional view in elevation of another embodiment of the edge fastener of this invention in which fastening flange 64*a* extends from outer portion 44*a* of female fitting 38*a*, and masking member 74*a* extends from outer portion 56a of male fitting 50a. In this embodiment, building panels 22a and 24a are adapted to be secured to a substrate or supporting structure (not shown) on the left-hand side of FIG. 2.

In this embodiment base portion 52a of male fitting 50a is bonded to edge 42a of building panel 22a. Outer portion 56a of male fitting 50a carries outwardly extending protuberance 58a, whose free end portion 60a has a shape generally complementary to the shape of cavity 46a of female fitting 38a. Female fitting 38a has inner base portion 40a that is bonded to edge 54a of building panel 24a, and outer portion 44a that defines cavity 46a with shoulder 48a on one side thereof.

In the embodiment shown in FIG. 2, protuberance 58a and masking member 74a extend along the entire length of the edge of building panel 22a, with both of those members projecting from outer portion 56a of male fitting 50a along that entire edge. To perform its complete function, masking member 74a must be a continuous member along the entire edge of fitting 50a, but if desired protuberance 58a may be intermittently positioned along that edge.

In this embodiment, free end 76a of fastening flange 64a forms a first butt joint with shoulder 62a on male fitting 50a. Free end 78a of masking member 74a forms a second butt joint with shoulder 48a on female fitting 38a.

Special Applications Of Edge Fastener Of This Invention

FIGS. 3–6 illustrate certain special applications of the two-piece edge fastener of this invention. These special applications illustrate the great flexibility of this edge fastener, and the ability of this device to adapt to a variety of structural and architectural requirements.

FIG. 3 is a sectional view in elevation of an embodiment of the edge fastener of this invention that differs from the embodiment of FIG. 1 principally in that reveal 80 is provided between adjoining building panels 22b and 24b. As in FIG. 1, base portion 40b of female fitting 38b is bonded to the edge of panel 22b, and base portion 52b of male fitting 50b is bonded to the edge of panel 24b. Free end portion 60b of outwardly extending protuberance 58b carried by male fitting 50b is complementary in shape to cavity 46b that is defined by outer portion 44b of female fitting 38b.

Fastening flange 64b extends outwardly from outer portion 56b of male fitting 50b, and its free end 76b terminates adjacent shoulder 48b of female fitting 38b. Masking member 74b extends outwardly from outer portion 44b of female fitting 38b, and its free end 78b terminates adjacent shoulder 62b of male fitting 50b.

Figure 6:
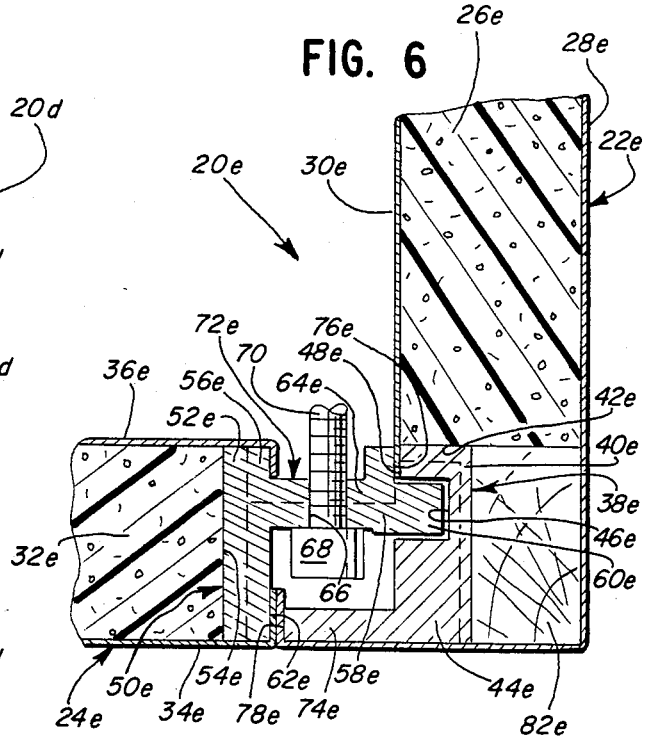
FIG. 6 is a sectional view in elevation of another embodiment of the edge fastener of this invention incorporated in a soffit return.

FIG. 4 is a sectional view in plan of another embodiment of the edge fastener of this invention that is incorporated in an outside corner between two adjoining building panels 22c and 24c. FIG. 5 is a sectional view in elevation of another embodiment of the edge fastener of this invention incorporated in a coping or sill formed by two adjoining panels 22d and 24d. FIG. 6 is a sectional view in elevation of another embodiment of the edge fastener of this invention incorporated in a soffit return that includes two adjoining building panels 22e and 24e.

In each of FIGS. 4–6, the principal elements of the edge fastener of this invention are designated by numerals that correspond to the numerals employed in FIGS. 1–3 for the same elements, but with different letter suffixes.

It will also be noted that in each case an inside framing block is included in the structure illustrated. In FIGS. 4 and 6, inside framing blocks 82c and 82e, respectively, are shown in the lower right-hand corner of these Figures. In FIG. 5, inside framing block 82d is shown in the upper right-hand corner of the Figure.

Embodiment For Panels Subject To Expansion And Contraction

Figure 7:
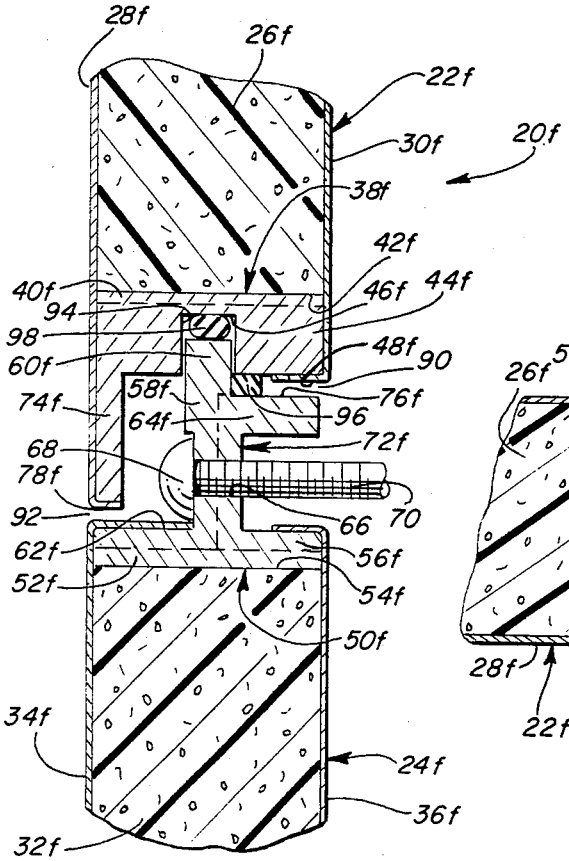
FIG. 7 is a sectional view in elevation of another embodiment of the edge fastener of this invention in which an airtight and moistureproof seal is provided between vertically adjoining panels.
Figure 8:
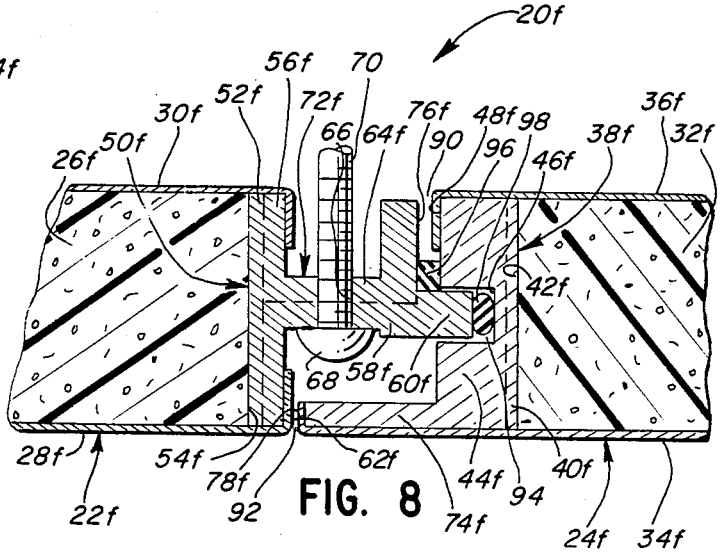
FIG. 8 is a sectional view in plan of an embodiment similar to the edge fastener of FIG. 7 in which an airtight and moistureproof seal is provided between horizontally adjoining panels.

FIGS. 7 and 8 are sectional views in elevation and plan, respectively, of the edge fastener of this invention adapted for use in situations where variations in the ambient temperature and/or absorption of solar heat can cause expansion and contraction of the building panels, and as a result it is necessary to provide an airtight and moistureproof seal between adjoining panels.

In FIG. 7, female fitting 38f is bonded to edge 42f of building panel 22f, and male fitting 50f is bonded to edge 54f of panel 24f. As in FIG. 1, edge fastener 20f is adapted to secure panels 22f and 24f to a substrate or supporting structure (not shown) located on the right-hand side of FIG. 7.

The two-piece edge fastener illustrated in FIG. 7 differs in concept from the edge fastener illustrated in FIG. 1 in the following respects:

1. Free end 76f of fastening flange 64f carried by male fitting 50f is spaced from shoulder 48f of female fitting 38f to form first gap 90.
2. Free end 78f of masking member 74f carried by female fitting 38f is spaced from shoulder 62f of male fitting 50f to form second gap 92.
3. Free end portion 60f of protuberance 58f is spaced from the bottom of cavity 46f to form a third gap 94.
4. Compressible, resilient gasket 96 is positioned in a slightly compressed state within first gap 90, extending from one end of said gap to the other end.
5. Compressible, resilient gasket 98 is positioned in a slightly compressed state within third gap 94, extending from one end of said gap to the other, parallel to the edges of panels 22f and 24f.

When interior face layers 30f and 36f and exterior face layers 28f and 34f of building panels 22f and 24f, respectively, are formed of metal, these metal facings are of course impervious to wind and water, but are susceptible to expansion and contraction under the influence of solar heat or changes in the ambient temperature. This expansion and contraction will be focused at the joints between adjacent building panels, which joints must therefore be able to accommodate movement of the panels and at the same time prevent leakage of water, moisture vapor, air, and other gases through the joints. Entry into and passage through the joints between adjacent building panels can occur through (1) the kinetic effect of the force of winds directed against the wall formed by the building panels, (2) capillary action across the joints between adjacent building panels, and/or (3) pressure differences across the paneled wall.

As will be seen from FIG. 7, gaskets 96 and 98, which are assembled within gaps 90 and 94, respectively, in a slightly compressed state, provide an effective barrier against (1) water and moisture vapor penetration, (2) passage of air or other vapors, and (3) heat loss, through the wall formed of the assembled panels. Because the gaskets are compressible, they will perform these functions when the metal facings of the building panels expand under the influence of elevated temperatures. Because the gaskets are formed of a resilient material, they will continue to perform the same functions when the metal facing layers of the building panels contract under lowered temperatures.

Those skilled in the art will understand that proper installation of the building panels with use of the two-piece edge fastener of this invention will require appropriate design spacing of the panels and proper positioning of the fasteners, with necessary clearance in holes 66 of the fastening flange (together with suitable rubber washers positioned under the fastener head as seals) whenever a temperature responsive embodiment such as shown in FIGS. 7 and 8 is employed.

Leaving gap 92 unobstructed under conditions of maximum expansion of the metal facing of the building panels leaves an exit route for any condensate or other liquid that may accumulate within the space between protuberance 58*f* and masking member 74*f*. At the same time, as pointed out above, groove 72*f* (oriented horizontally in this Figure) performs the same function on the interior side of building panels 22*f* and 24*f*.

FIG. 8 provides a sectional view in plan of an embodiment that is identical to the edge fastener of FIG. 7 except that it is employed to connect horizontally adjacent building panels instead of vertically adjacent panels. In FIG. 8 the elements of the edge fastener are designated by the same numerals as those employed for the corresponding elements in FIG. 7.

Here, again, compressible, resilient gaskets 96 and 98 provide an airtight and moistureproof barrier between the interior and exterior of the wall formed of the building panels joined by a plurality of fasteners 20*f*. Gap 92 likewise provides an exit route for condensate and other liquids that may accumulate within the edge fastener near its external face, and groove 72*f* (oriented vertically in this Figure) provides a similar escape route for condensate and other liquids accumulating at the interior face of the wall formed by panels 22*f* and 24*f*.

The above detailed description has been given for ease of understanding only. No unnecessary restrictions should be understood therefrom, as modifications will be obvious to those skilled in the art.

I claim:

1. The combination of a two-piece edge fastener with two building panels having adjoining edges, one of said two pieces of said edge fastener being bonded to the adjoining edge of the first of said two building panels and the other of said two pieces being bonded to the adjoining edge of the second of said two building panels, each of said panels having an interior face and an exterior face, said edge fastener being adapted to secure said two panels to a substrate or supporting structure with the interior face of each panel adjacent said substrate or supporting structure, said edge fastener comprising:

(a) a first, female fitting having an inner base portion bonded to the adjoining edge of one of said panels, and an outer portion defining a cavity with a shoulder on one side thereof;

(b) a second, male fitting having an inner base portion bonded to the adjoining edge of the other of said panels, and an outer portion carrying an outwardly extending protuberance, the free end portion of said protuberance having a shape at least generally complementary to the shape of said cavity, said outer portion of the male fitting having a shoulder on one side of said protuberance;

(c) a fastening flange extending rigidly outwardly from the outer portion of one of said two fittings adjacent the interior faces of said two panels when the panels are installed in place, said flange defining a hole for receiving the hereinafter mentioned fastener and having a free end portion;

(d) a fastener having an enlarged head and a shank for attaching said fastening flange of said one fitting to said substrate or supporting structure; and (e) a masking member extending rigidly outwardly from the outer portion of the other of said two fittings to conceal said fastener head from view when the fastener is installed in place securing said one fitting to said substrate or supporting structure, said masking member having a midportion and a free end and being spaced for at least a portion of its length from said fastening flange to provide clearance for said fastener head, said clearance for said fastener head extending from said midportion of said masking member to said free end thereof.

said female fitting and either (i) said fastening flange or (ii) said masking member being integrally formed with each other, rigid throughout their extent, and formed separately from said two building panels, said male fitting and the other of (i) said fastening flange and (ii) said masking member being integrally formed with each other, rigid throughout their extent, and formed separately from said two building panels, the free end portion of said fastening flange that is carried by said one fitting terminating adjacent said shoulder on the other of said fittings, and the free end portion of said masking member carried by said other fitting terminating adjacent said shoulder of said one fitting that carries said fastening flange, each of said building panels being a laminated panel formed of a lightweight core with a thin skin layer bonded to each face thereof to form a sandwich of said core between said thin layers, the exterior skin layer of each of said panels extending beyond the outer edge of the fitting that is associated with said panel and extending inward between said two fittings.

2. The combination edge fastener and panels of claim 1 in which the free end of said fastening flange carried by said one fitting forms a first butt joint with said shoulder on the other of said fittings, and the free end of said masking member carried by said other fitting forms a second butt joint with said shoulder of said one fitting that carries said fastening flange.

3. The combination edge fastener and panels of claim 2 in which the portion of said exterior skin layer of each of said panels that extends beyond the outer edge of the fitting associated with said panel extends inward into said second butt joint.

4. The combination edge fastener and panels of claim 3 in which the interior skin layer of the panel associated with said fitting that carries said masking member extends beyond the outer edge of said fitting and into said first butt joint.

5. The combination edge fastener and panels of claim 1 in which (a) the free end of said fastening flange that is carried by said one fitting is spaced from said shoulder on the other of said fittings to form a first gap, (b) the free end of said masking member carried by said other fitting is spaced from said shoulder of said one fitting that carries said fastening flange, to form a second gap, (c) the free end of said protuberance is spaced from the bottom of said cavity to form a third gap, (d) a compressible, resilient gasket is positioned in a slightly compressed state within said first gap and extends from one end of said gap to the other end, and (e) a compressible, resilient gasket is positioned in a slightly compressed state within said third gap and extends from one end of said gap to the other end.

6. The combination edge fastener and panels of claim 1 in which a groove is provided in said fastening flange adjacent the interior faces of said two panels when the panels are installed in place, to provide an exit channel for condensate and other liquid that may accumulate in said groove.

7. The combination edge fastener and panels of claim 1 in which said enlarged fastener head is free to apply its full tightening force to said fastening flange, to render said fastening flange in turn fully tightenable against said substrate or supporting structure.

8. A two-piece edge fastener for bonding to the adjoining edges of two building panels, in combination with two laminated building panels, each of said panels having an interior face and an exterior face, said edge fastener being adapted to secure said two panels to a substrate or a supporting structure with the interior surface of each panel adjacent said substrate or supporting structure, which edge fastener comprises:

(a) a first, female fitting having an inner portion for bonding to the edge of one of said panels, and an outer portion defining a cavity with a shoulder on one side thereof;

(b) a second, male fitting having an inner base portion for bonding to the edge of the other of said panels, and an outer portion carrying an outwardly extending protuberance, the free end portion of said protuberance having said cavity, said outer portion of the male fitting having a shoulder on one side of said protuberance;

(c) a fastening flange extending rigidly outwardly from the outer portion of said second, male fitting adjacent to the interior faces of said two panels when the panels are installed in place, said flange defining a hole for receiving a fastener having an enlarged head and a shank for attaching said male fitting to said substrate or supporting structure and having a free end; and (d) a masking member extending rigidly outwardly from the outer portion of said first, female fitting to conceal said fastener head from view when the fastener is installed in place securing said male fitting to said substrate or supporting structure, said masking member having a midportion and a free end and being spaced for at least a portion of its length from said fastening flange to provide clearance for said fastener head, said clearance for said fastener head extending from said midportion of said masking member to said free end thereof, said female fitting and said masking member being integrally formed, rigid throughout their extent, and formed separately from said two building panels, said male fitting and said fastening flange being integrally formed, rigid throughout their extent, and formed separately from said two building panels, the free end of said fastening flange that is carried by said male fitting forming a first butt joint with said shoulder on said female fitting, and the free end of said masking member carried by said female fitting forming a second butt joint with said shoulder of said male fitting, each of said laminated panels being formed of a lightweight core with a thin skin layer bonded to each face thereof to form a sandwich of said core between said two thin layers, the exterior skin layer of each of said panels extending beyond the outer edge of the fitting associated with said panel and inward into said second butt joint, the interior skin layer of the panel associated with said masking member extending beyond the outer edge of said fitting and into said first butt joint.

9. A two-piece edge fastener for bonding to the adjoining edges of two building panels, each of said panels having an interior face and an exterior face, said edge fastener being adapted to secure said two panels to a substrate or a supporting structure with the interior surface of each panel adjacent said substrate or supporting structure, which edge fastener comprises:

(a) a first, female fitting having an inner base portion for bonding to the edge of one of said panels, and an outer portion defining a cavity with a shoulder on one side thereof;

(b) a second, male fitting having an inner base portion for bonding to the edge of the other of said panels, and an outer portion carrying an outwardly extending protuberance, the free end portion of said protuberance having a shape generally complementary to the shape of said cavity, said outer portion of the male fitting having a shoulder on one side of said protuberance;

(c) a fastening flange extending rigidly outwardly from the outer portion of said second, male fitting adjacent to the interior faces of said two panels when the panels are installed in place, said flange defining a hole for receiving a fastener having an enlarged head and a shank for attaching said male fitting to said substrate or supporting structure and having a free end, a groove being provided in said fastening flange adjacent the interior faces of said two panels when the panels are installed in place, to provide an exit channel for condensate and other liquid that may accumulate in said groove;

(d) a masking member extending rigidly outwardly from the outer portion of said first, female fitting to conceal said fastener head from view when the fastener is installed in place securing said male fitting to said substrate or supporting structure, said masking member being spaced for at least a portion of its length from said fastening flange to provide clearance for said fastener head, said clearance for said fastening head extending from said midportion of said masking member to said free end thereof, said female fitting and said masking member being integrally formed, rigid throughout their extent, and formed separately from said two building panels, said male fitting and said fastening flange being integrally formed, rigid throughout their extent, and formed separately from said two building panels, the free end of said fastening flange that is carried by said male fitting being spaced from said shoulder on said female fitting to form a first gap, the free end of said masking member carried by said female fitting being spaced from said shoulder of said male fitting to form a second gap, and the free end of said protuberance being spaced from the bottom of said cavity; and (e) a compressible, resilient gasket positioned in a slightly compressed state within each of said first and third gaps and extending from one end of each of said gaps to the other end thereof, parallel to the edges of said building panels that are connected by said fastener.

* * * * *

UNITED STATES PATENT AND TRADEMARK OFFICE

CERTIFICATE OF CORRECTION

PATENT NO. : 4,741,136

DATED : May 3, 1988

INVENTOR(S) : Gerald M. Thompson

It is certified that error appears in the above-identified patent and that said Letters Patent is hereby corrected as shown below:

Col. 4, delete the paragraph beginning on line 31 and ending on line 36.

Signed and Sealed this

Seventh Day of February, 1989

*Attest:*

DONALD J. QUIGG

*Attesting Officer*

*Commissioner of Patents and Trademarks*